US008857091B2

(12) United States Patent
Delgado Acarreta

(10) Patent No.: US 8,857,091 B2
(45) Date of Patent: Oct. 14, 2014

(54) LOCKING DEVICE

(76) Inventor: Raúl Delgado Acarreta, Navarra (ES)

( * ) Notice: Subject to any disclaimer, the term of this patent is extended or adjusted under 35 U.S.C. 154(b) by 81 days.

(21) Appl. No.: 13/813,116

(22) PCT Filed: Jul. 30, 2010

(86) PCT No.: PCT/ES2010/070536

§ 371 (c)(1),
(2), (4) Date: Apr. 10, 2013

(87) PCT Pub. No.: WO2012/013835

PCT Pub. Date: Feb. 2, 2012

(65) Prior Publication Data

US 2013/0185977 A1 Jul. 25, 2013

(51) Int. Cl.
*F41A 17/46* (2006.01)
*F41A 17/52* (2006.01)

(52) U.S. Cl.
CPC ..... *F41A 17/46* (2013.01); *F41A 17/52* (2013.01)
USPC ..... 42/70.06

(58) Field of Classification Search
CPC ..... F41A 17/46; F41A 17/06; F41A 17/30; F41A 17/52; F41A 17/64
USPC ..... 42/70.01–70.11
See application file for complete search history.

(56) References Cited

U.S. PATENT DOCUMENTS 2,553,995 A * 5/1951 Young ..... 42/70.04
2,679,706 A * 6/1954 Windle ..... 42/70.08
3,903,631 A * 9/1975 Vesamaa ..... 42/70.01
4,151,670 A * 5/1979 Rath ..... 42/70.06
4,156,170 A 5/1979 Strunc
4,682,435 A * 7/1987 Heltzel ..... 42/70.01
4,739,569 A * 4/1988 Battle ..... 42/1.01
4,926,574 A 5/1990 Rieger
5,016,378 A * 5/1991 Sain ..... 42/70.06
5,067,266 A * 11/1991 Findlay ..... 42/70.08
5,068,990 A * 12/1991 Marzocco ..... 42/70.04
5,417,001 A 5/1995 Rousseau
5,465,518 A 11/1995 Blaser
5,784,818 A * 7/1998 Otteson ..... 42/70.04
6,131,325 A * 10/2000 Kefer ..... 42/70.05
6,256,917 B1 * 7/2001 Findlay ..... 42/70.06
6,308,449 B1 * 10/2001 Plebani ..... 42/70.08

(Continued)

FOREIGN PATENT DOCUMENTS

JP 8271189 A 10/1996

OTHER PUBLICATIONS

International Search Report issued in PCT/ES2010/070536 on May 20, 2011.

*Primary Examiner* — Michael David
(74) *Attorney, Agent, or Firm* — Blank Rome LLP

(57) ABSTRACT

Kit-form locking device that may be fitted to a firearm (11), which comprises a trigger (23), included within a firing chain of the firearm, which includes a first, exterior trigger lever (231) that can be actuated by a potential user, and a second, interior trigger part (232) that can be mechanically associated with a manual safety device (22) of the firearm; the locking device comprises a movable locking component (20) adapted for entering into mechanical contact with the second, interior trigger part (232) and with the first, interior part (222) of the manual safety device located in the release position thereof when the locker (20) is in a locking position.

17 Claims, 5 Drawing Sheets

(56) References Cited

U.S. PATENT DOCUMENTS

| | | | | |
|---|---|---|---|---|
| 6,588,136 | B2 * | 7/2003 | Baker et al. | 42/70.05 |
| 7,076,903 | B2 * | 7/2006 | Edwards | 42/70.08 |
| 7,360,332 | B2 * | 4/2008 | Rozovsky | 42/70.07 |
| 7,617,628 | B2 * | 11/2009 | Curry | 42/70.02 |
| 7,703,230 | B2 * | 4/2010 | Curry et al. | 42/70.08 |
| 7,908,779 | B2 * | 3/2011 | Wasmer | 42/1.05 |
| 8,132,496 | B2 * | 3/2012 | Zukowski | 89/142 |
| 8,276,302 | B2 * | 10/2012 | Zukowski | 42/70.01 |
| 8,464,456 | B2 * | 6/2013 | Pichler | 42/70.08 |
| 8,650,788 | B2 * | 2/2014 | Ostanin | 42/70.08 |
| 8,677,665 | B1 * | 3/2014 | Huber | 42/70.04 |

* cited by examiner

LOCKING DEVICE

This application is the U.S. national stage of International Patent Application No. PCT/ES2010/070536, filed Jul. 30, 2010.

OBJECT OF THE INVENTION

The present invention relates to a blocking device for use in a firearm.

STATE OF THE ART

In general, the use of a firearm is restricted to its availability and to having the necessary skills to use it, notwithstanding having the corresponding government authorisation. Therefore, in the improbable case that a person authorised to possess and use a firearm, such as a civilian in his/her house, a member of a police force or a soldier in a military operation, has his/her standard-issue weapon stolen or taken away from him/her, it could be unavoidably used against him/her.

Other risk situations arise in the case of a weapon that falls and is accidentally discharged. Other cases are known in which a weapon, left briefly unattended by its owner, usually in a safe environment such as the home, is manipulated by an inexperienced person or minor, causing fatal accidents due to an accidental discharge.

A blocking mechanism of a handgun comprising a control unit configured to compare an identification signal introduced using an alphanumeric keyboard is known to exist in the state of the art, having an identification code stored in a memory unit; an actuation device that interacts with the control unit and is connected by a threaded spindle and a threaded connection with a mechanical blocking element that moves between a blocking position and an unblocking position, where the blocking element blocks the handgun trigger tongue, a battery for supplying power to the blocking mechanism and a plurality of indicator elements configured for indicating the status of the blocking mechanism. By interacting with the control unit, the blocking mechanism can switch from the blocking position of the discharge mechanism to the unblocking position thereof and vice versa.

However, the aforementioned blocking mechanism has the drawback that it is subject to flexion when the trigger is actuated. Consequently, its reliability and robustness decrease, in addition to that of the firearm.

CHARACTERISATION OF THE INVENTION

The present invention seeks to resolve one or more of the aforementioned drawbacks through the use of a blocking device for a firearm, as claimed in claim 1.

An object of the blocking mechanism configured as a kit that can be assembled at origin on the firearm or can be adapted to a firearm already in service is that the firearm comprises a trigger that forms part of a trip chain of the firearm, where the trigger includes a first external trigger lever that can be actuated by a potential user of the firearm and a second internal trigger part that can be mechanically associated with a manual safety catch of the firearm, wherein the blocking device comprises a mobile blocking element adapted to come into contact with the second internal trigger part and with the first internal part of the manual safety catch disposed in its unblocking position, when the blocking device is in a blocking position.

Another object of the blocking device is to use a guiding element such as the hammer recovery elements to guide the blocking element along its sliding movement from the blocking position to the unblocking position and vice versa.

Yet another object of the blocking device is to provide a device configured to actuate the trigger and safety catch of the shotgun-type firearm.

Another object of the device is to supply a mechanical interface mechanically connected to the blocking element, the ends of which have C-type terminations adapted to mechanically embrace a hammer recovery element.

The blocking element is mechanically joined to an actuation element that can transmit, through the mechanical interface, a sliding movement to the blocking element so that said blocking element moves from the blocking position to the unblocking position and vice versa.

The actuation element is mechanically connected to the blocking element through the mechanical interface, the configuration and dimensions of which depend on the location of the actuation element within the fire arm.

The actuation element can be assembled inside the butt of the firearm or next to the trigger guard.

Another object of the invention is to provide a secure identification control unit configured to interact with the blocking device to allow an authorised user to use the firearm.

A potential user of the firearm must introduce an identification code for comparison with a code previously stored by the control unit. If the result of the comparison is positive, the blocking device switches to an unblocking position in such a manner that only the manual safety catch of the firearm or other types of safety catches can prevent the percussion of the firearm hammer.

Another object of the invention is to provide a blocking mechanism that will enable blocking and unblocking of the firearm without need to press the actuator or trigger.

Yet another object of the invention is to provide a blocking device in the manner of a kit, configured to adapt to a shotgun-type firearm, always preserving the initial structure of the shotgun-type firearm already in service and without need to use supplementary machining of the firearm or its constituent parts to assemble the kit.

BRIEF DESCRIPTION OF THE DRAWINGS

A more detailed explanation of the invention is included in the following description, which is based on the attached figures.

DESCRIPTION OF THE INVENTION

Figure 1:
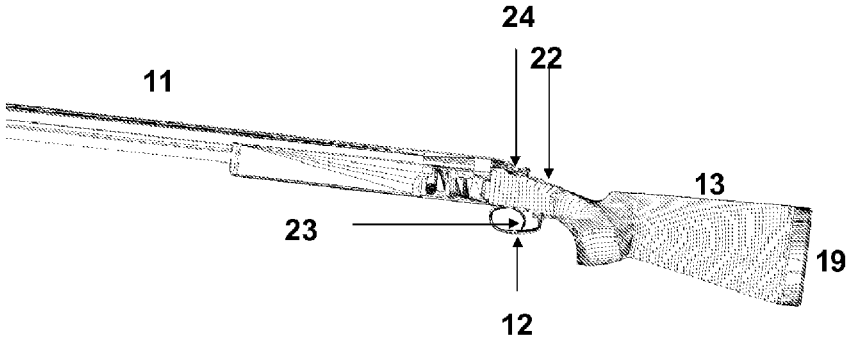
FIG. 1 shows an elevational view of a shotgun-type firearm.

FIG. 1 shows a shotgun-type firearm (11) comprising a butt (13) and a butt-pad (19) at one of its ends for leaning against the body of a potential user; a trigger guard (12) is disposed at the opposite end of the butt that protects the trigger (23), comprised within a trip chain of the firearm (11); a manual safety catch (22) and safety latch (14) of the firearm (11) are disposed on the upper part of the trigger guard (12).

Figure 2:
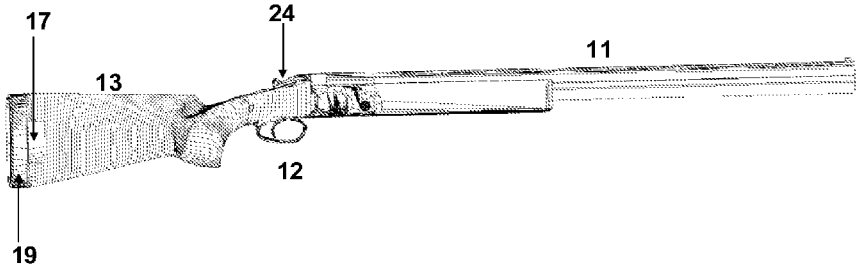
FIG. 2 shows an elevational view of a control unit of the blocking device installed on the butt next to the shotgun butt-pad.
Figure 3:
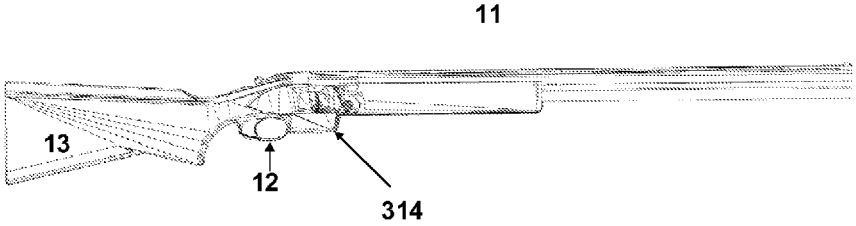
FIG. 3 shows an elevational view of a blocking device assembled next to the shotgun trigger guard.

In relation to FIG. 2, a blocking device in the form of a kit can be assembled at origin on the shotgun (11) or be susceptible of being adapted to a shotgun already in service, installed next to the trigger guard (12), inside a box (314).

Likewise, the kit of the blocking device can be assembled inside the butt (13) of the firearm (11) and next to the butt-pad (19) thereof (see FIG. 2).

Figure 4:
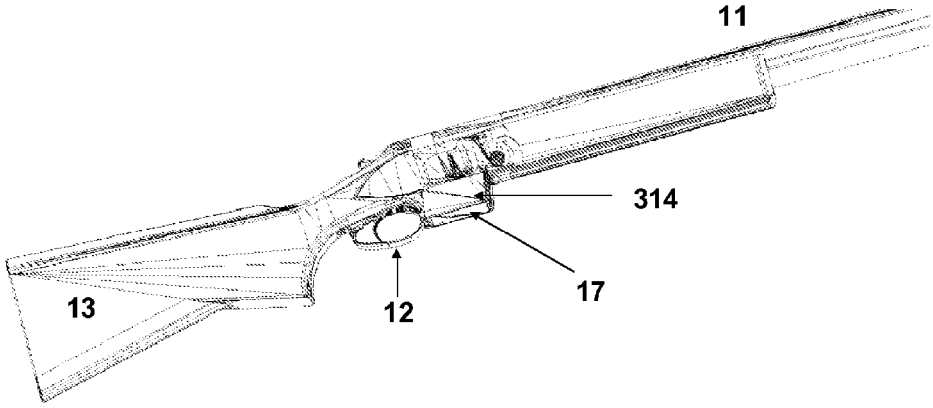
FIG. 4 shows a lower perspective view of the input/output unit of the identification control unit of the blocking device, assembled next to the shotgun trigger guard.

In relation to FIGS. 2 and 4, the blocking device also comprises an identification control unit (not represented), electrically connected to an input/output unit (17), wherethrough a potential user can transmit and receive messages associated with the identification of the potential user of the firearm (11) to and from the control unit.

Figure 5:
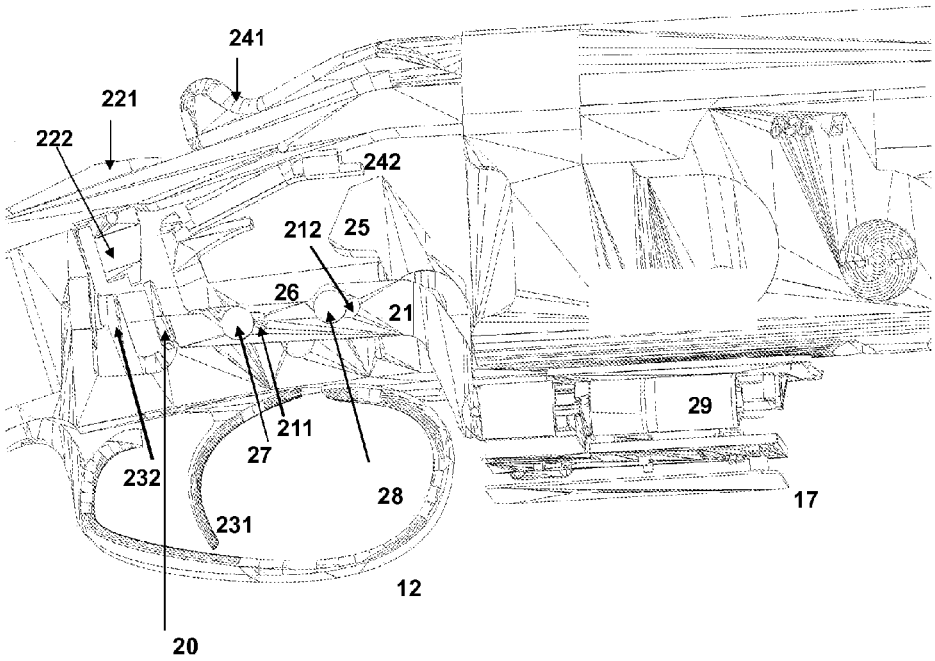
FIG. 5 shows an elevational view of the shotgun trip chain area, which includes the blocking device.

In relation to FIG. 5, the manual safety catch 22 comprises a first external lever (221) that can be actuated by the user and which is mechanically associated with a first internal part (222) that can make mechanical contact, in a blocking or actuation position, with a second internal part (232) of the trigger which is also mechanically associated with a first external lever (231) of the trigger that can be actuated by the user.

The safety latch (24) comprises a first external part (241) that can be actuated by the user and a second internal part (242) that can be mechanically associated with the trip chain of the firearm (11).

The trip chain of the firearm also comprises a set of hammers (25), hammer recovery elements (26), a first trigger shaft (27) and a second catch shaft (28).

Figure 6:
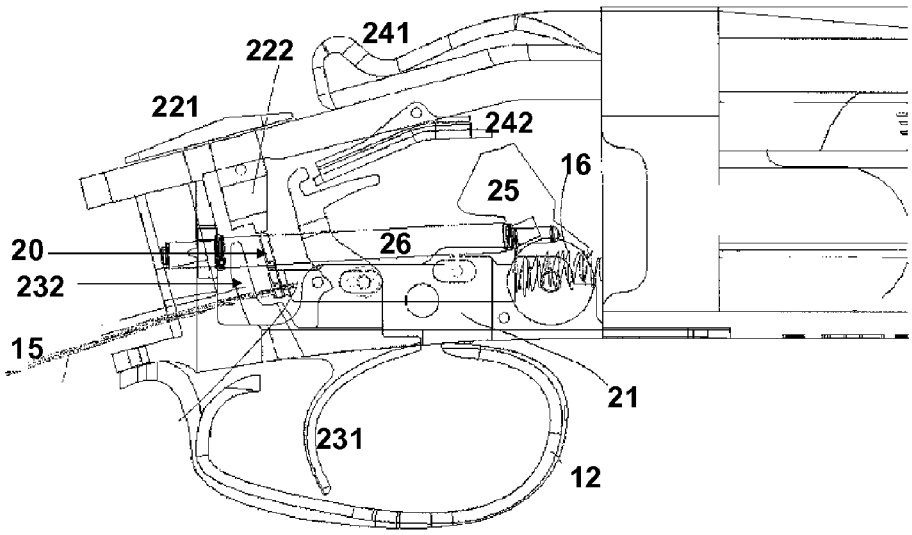
FIG. 6 shows an elevational view of the shotgun trip chain area, where a manual safety catch is unblocked and a blocking element of the blocking device is in the blocking position.

In relation to FIG. 6, the blocking device comprises a mobile blocking element (20) adapted for making mechanical contact with the second internal trigger part (232) and with the first internal part (222) of the manual safety catch disposed in its unblocking position, when the blocker (20) is in the blocking position.

Figure 7:
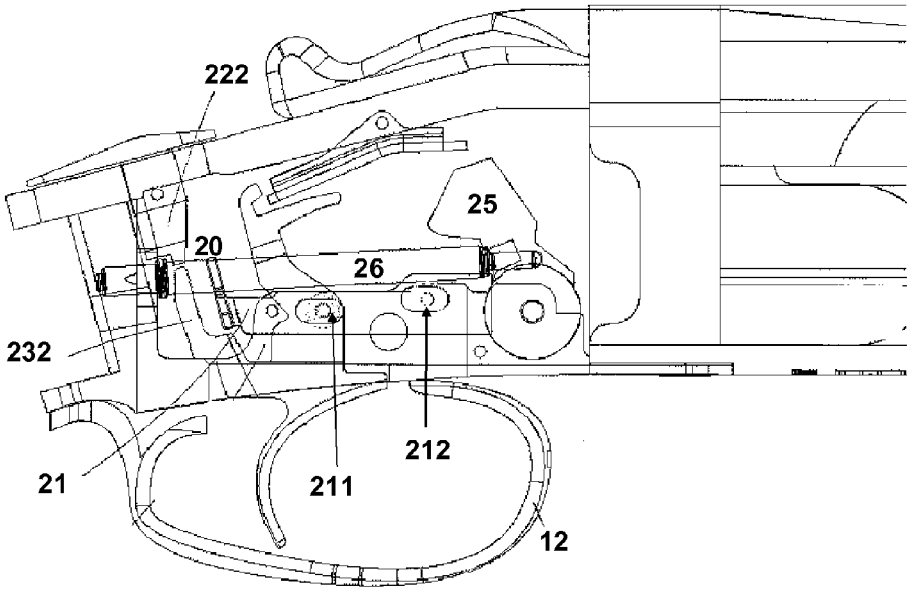
FIG. 7 shows an elevational view of the shotgun trip chain area, where the manual safety catch is blocked and the blocking element of the blocking device is in the blocking position.
Figure 8:
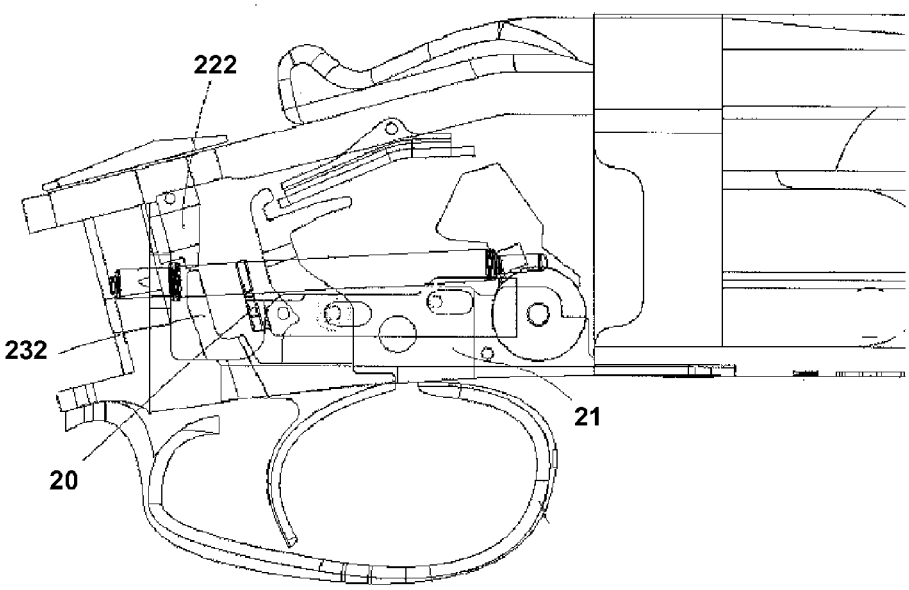
FIG. 8 shows an elevational view of the shotgun trip chain, where the manual safety catch is blocked and the blocking element of the blocking device is in the unblocking position.
Figure 9:
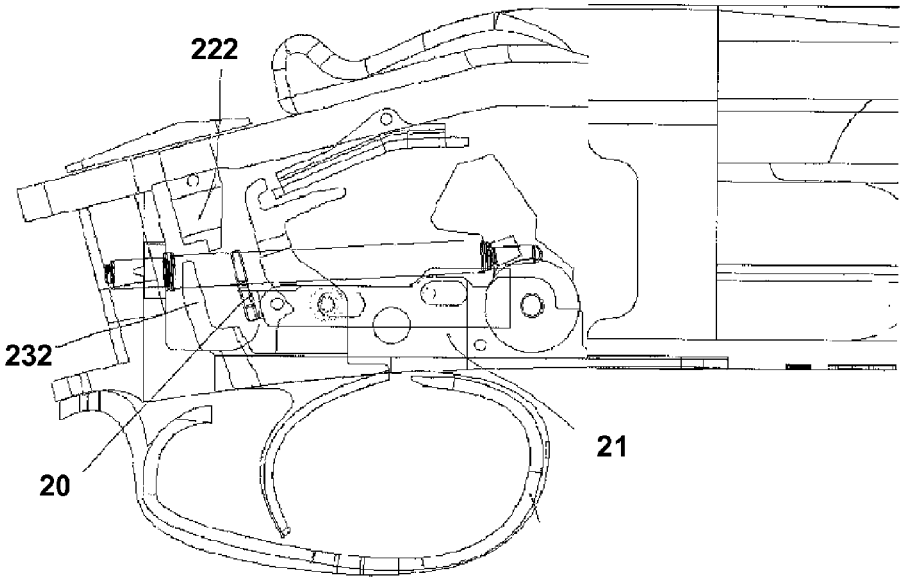
FIG. 9 shows an elevational view of the shotgun trip chain, where the manual safety catch is unblocked and the blocking element of the blocking device is in the unblocking position.

Therefore, when the manual safety catch (22) is in its blocking position, there is no mechanical contact with the blocker (20) in its blocking or unblocking position (see FIGS. 7 and 8).

In relation to FIG. 5, the blocking element (20) is guided along a sliding movement from the blocking position to the unblocking position thereof and vice versa by guiding elements or a mechanical interface (21).

The blocking device comprises an actuation element (29) adapted to generate a movement that is transformed into a sliding movement of the blocker (20) by the mechanical interface (21).

The actuation element (29) can comprise an electric motor reducer, an electromagnet or other means capable of generating a movement susceptible of being transformed into a sliding movement by the mechanical interface (21).

The blocking element (20) is mechanically connected to the actuation element (29) through the mechanical interface (21), in such a manner that when actuated, the blocker (20) moves between its blocking position and its unblocking position and vice versa.

Therefore, the blocker (20) is configured to interact mechanically with a first trigger shaft (27) and a second catch shaft (28) of the firearm, that form part of the original shotgun, which enable and guide the sliding movement of the mechanical interface (21) and, therefore, of the blocker (20).

To this end, the mechanical interface (21) comprises corresponding elongated cavities or groove-shaped holes (211, 212) which are adapted to allow the first and second shaft (27, 28) to be inserted therein (211, 212).

The physical dimensions of the groove-shaped holes (211, 212) determine the maximum length of the sliding movement of the blocker (20) between the blocking position and the unblocking position and vice versa.

The blocking element (20) can take the form of a strip that can enter or block, and exit or unblock the trip chain. The blocking element (20) is moved between the discharge blocking position and unblocking position by the actuation element (29) and mechanical interface (21) assembly.

In such a manner that when the blocking element (20) is in the blocking position and regardless of the position of the manual safety catch (22), the blocking element (20) acts as an extension of the manual safety catch (22) of the firearm. Therefore, if the first external lever (231) of the trigger is actuated, the blocking element (20) makes mechanical contact with the first internal part of the trigger 231 and prevents initiation of the mechanical firing sequence (see FIGS. 6 and 7).

The blocking element (20), in its blocking position, makes mechanical contact with the first internal part of the trigger (231) and also with the manual safety catch (22) when it is, in turn, in its unblocking position (see FIG. 6).

Likewise, if the manual safety catch (22) is actuated, blocked, and the blocking element (20) is in the unblocking position, the firearm is not ready to be fired, i.e. it cannot initiate the mechanical firing sequence (see FIG. 8).

In the event that the manual safety catch (22) is positioned in the unblocking position, i.e. the manual safety catch (22) is released and the blocking element (20) is in the blocking position, the firearm is not ready to be fired and, therefore, the mechanical firing sequence of a shot cannot be initiated (see FIG. 6).

The identification control unit stores an authorised user identification code on a removable storage device; a potential user can introduce an identification code through the input/output unit (17) that is transmitted to the control unit, which subjects the code received to a comparison or verification stage by comparison with the stored identification code.

In the event that the control unit obtains a positive result during the comparison stage, the control unit emits an electrical actuation signal toward the actuation element (29), in such a manner that the blocker (20) is moved by means of the mechanical interface (21) from its blocking position to its unblocking position or vice versa.

Once the blocking device is in the unblocking position and the manual safety catch (22) of the firearm is also in the unblocking position, the firearm is ready to be fired.

One of the advantages of the blocking device is that its operation is independent of the manual safety catch (22) and safety latch (24) of the shotgun (11), which in no case are disabled, but rather the blocking device adds to the actuation thereof, enabling actuation of any of the aforementioned safety catches in any position of the blocking element (20).

In summary, the firearm (11) is ready to be fired both if the manual safety catch (22) and the blocking device are in the unblocking position.

Figure 10:
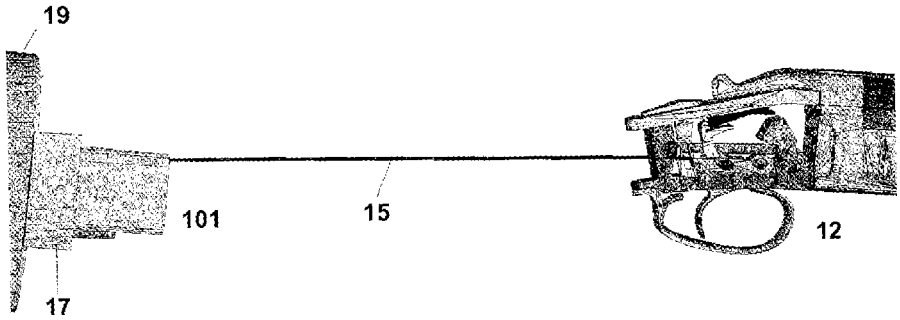
FIG. 10 shows an elevational view of the blocking device assembled next to the butt-pad and inside the butt (not represented)

In relation to FIG. 10, in another embodiment the actuator (29) and the control unit can be assembled on the butt (13) of the firearm, next to the butt-pad. In said embodiment, the actuation (29) can connect the blocking element (20) by means of a rigid or semi-rigid element (15) that is actuated by the motor (29).

The rigid or semi-rigid element (15) is housed in the interior of an orifice made in the butt (13). In the case of a semi-rigid element, for example, a cable, as a means for recovering the blocking element (20), a spring (16) is disposed on the rear end of the mechanical interface (21) joined to the body of the mechanism (see FIG. 6).

Figure 11:
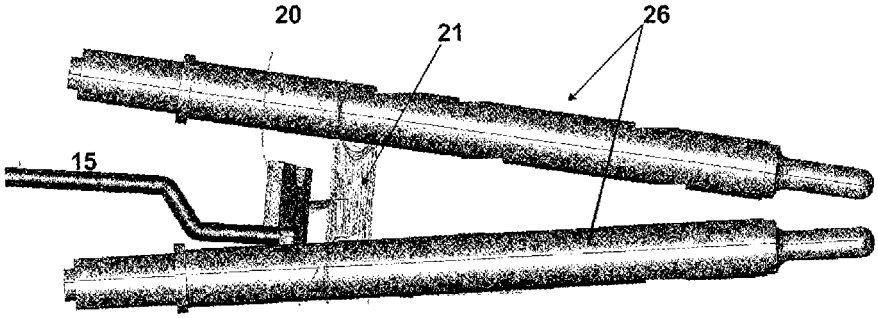
FIG. 11 shows a top plan view of an embodiment of a mechanical interface assembled between hammer recovery elements.

FIG. 11 shows another embodiment of the blocking element (20), which is adapted to be mechanically joined to the hammer springs (25) through the modified mechanical interface (21).

The mechanical interface (21) is assembled between the two recovery springs and have C-type terminations adapted to embrace the aforementioned recovery springs (26).

An advantage of the blocking element (20) arises from its assembly as, in the blocking position, the blocker (20) is subject to compression when the trigger (23) is actuated, said stress being better endured than if it were subject to flexion, thereby increasing the robustness and, therefore, reliability of the blocking device.

The design, dimensions and installation of the blocker (20) are such that they avoid having to exert a strong force to generate the sliding movement of the blocker (20) toward and/or from the blocking position. Therefore, the actuation element (29) does not require great effort to generate the sliding movement of the blocking device.

The motor reducer (29) can be assembled either next to the trigger guard (12) or at the front of the butt (13). Therefore, the blocking element (20) can be actuated at front or rear part thereof.

Returning to FIG. 5, the motor reducer (19) installed next to the trigger guard (12) comprises a motor spindle, a thruster that transforms the rotary movement of the spindle into a linear sliding movement and a thruster shaft that engages mechanically with an extension of the mechanical interface (21).

The aforementioned elements are disposed inside the box (314) to prevent damage thereto caused, for example, by an accidental impact The user may activate and deactivate the blocking device of the firearm by means of the identity control unit. The control unit governs the operation of the actuator (29), in such a manner that if a potential user introduces a code in the input/output unit and the result of the verification is positive, the firearm is blocked or unblocked.

The input/output unit comprises an alphanumeric keyboard wherethrough an alphanumeric code can be introduced.

FIG. 10 shows the input/output unit (17), for example, a keyboard installed next to the butt-guard (19) and the identification control unit (101).

The input/output unit (17) includes a transceiver radio which can emit and/or receive messages that include an identification code by means of an air interface. The telecommunications air interface can be Bluetooth, wireless telecommunication, RF, etc.

The input/output unit (17) can also include a sensor device to detect the biometric parameters of a target user.

A potential user of the firearm can introduce an identification code for comparison with a code previously stored by the control unit.

The device also comprises a light-emitting diode integrated in the firearm next to the keyboard, which indicates firearm blocking status.

The blocking device includes a power supply in the form of an exchangeable rechargeable battery.

The invention claimed is:

1. A blocking device in the form of a kit configured for a firearm comprising:

a trigger, comprised within a trip chain of the firearm, a first external trigger lever included in the trigger, that can be actuated by a potential user, and at least one second internal trigger part mechanically associated with a manual safety catch of the firearm, wherein the blocking device comprises:

a mobile blocking element configured to make mechanical contact with the second internal trigger part and with the first internal part of the manual safety catch disposed in its unblocking position, when the blocking element is in a blocking position.

2. The device of claim 1 wherein the blocking element is adapted to be guided by a guiding element along its sliding movement from the blocking position to the unblocking position thereof and vice versa.

3. The device of claim 2 wherein the guiding unit includes hammer recovery elements.

4. The device of claim 3 wherein the hammer recovery elements are the hammer springs.

5. The device of claim 3 wherein the blocking element is connected to a mechanical interface comprising, at its ends, respectively, a C-type termination adapted to mechanically embrace a hammer recovery element.

6. The device of claim 2 wherein the blocking element is adapted to be mechanically joined by means of a mechanical interface to an actuation element.

7. The device of claim 6 wherein the mechanical interface is adapted to perform a sliding movement for the blocking element to move from the blocking position to the unblocking position and vice versa.

8. The device of claim 7 wherein the mechanical interface is adapted to interact mechanically with a first trigger shaft and a second catch shaft that guide the sliding movement and that of the blocking element from the blocking position to the unblocking position and vice versa.

9. The device of claim 8 wherein the configuration and dimensions of the mechanical interface are the result of the location of the actuation element inside the firearm.

10. The device of claim 6 wherein the actuation element is electrically connectable to an identification control unit adapted to generate and transmit an electrical signal toward the actuation element so that the blocking element can move from the blocking position to the unblocking position and vice versa.

11. The device of claim 10 wherein the identification control unit is adapted to store the identification code of an authorised user on a removable storage device.

12. The device of claim 11 wherein the identification control unit comprises an input/output unit whereby a potential user can introduce an identification code, which is adapted to compare the code received with the stored identification code.

13. The device of claim 12 wherein, if the result of the comparison is positive, the identification control unit generates and transmits an electrical signal toward the actuation element so that the blocking element can move from the blocking position to the unblocking position and vice versa.

14. The device of claim 6 wherein the actuation element can be assembled inside the butt of the firearm.

15. The device of claim 6 wherein the actuation element can be assembled next to the trigger guard of the firearm.

16. The device of claim 8 wherein the mechanical interface comprises at least two elongated cavities adapted for being respectively inserted into the first trigger shaft and the second catch shaft.

17. A firearm comprising a trigger that includes a first external trigger lever that can be actuated by a potential user, and a second internal trigger part mechanically associated with a manual safety catch of the firearm, characterized in that a blocking device in the form of a kit configured for the firearm comprising a trigger, comprised within a trip chain of the firearm, which includes a first external trigger lever that can be actuated by a potential user and at least one second internal trigger part mechanically associated with a manual safety catch of the firearm, characterized in that the blocking device comprises a mobile blocking element adapted to make mechanical contact with the second internal trigger part and with the first internal part of the manual safety catch disposed in its unblocking position, when the blocking element is in a blocking position.

* * * * *